US006055405A

United States Patent [19]

Knott et al.

[11] Patent Number: 6,055,405

[45] Date of Patent: Apr. 25, 2000

[54] CONVEYOR FOR USED TONER IN A CLEANING DEVICE OF AN ELECTROGRAPHIC PRINTER OR COPIER

[75] Inventors: Joseph Knott, Tutzing; Rainer Schröder, Poing, both of Germany

[73] Assignee: Océ Printing Systems GmbH, Poing, Germany

[21] Appl. No.: 09/068,599

[22] PCT Filed: Aug. 8, 1996

[86] PCT No.: PCT/DE96/01494

§ 371 Date: Sep. 24, 1998

§ 102(e) Date: Sep. 24, 1998

[87] PCT Pub. No.: WO97/18499

PCT Pub. Date: May 22, 1997

[30] Foreign Application Priority Data

Nov. 10, 1995 [DE] Germany ..... 195 42 028

[51] Int. Cl.[7] ..... G03G 21/00

[52] U.S. Cl. ..... 399/358; 399/256; 399/343

[58] Field of Search ..... 399/358, 256, 399/254, 35, 261, 258; 198/670, 659, 657; 222/342; 15/308, 256.5

[56] References Cited

U.S. PATENT DOCUMENTS

| | | | |
|---|---|---|---|
| 3,572,555 | 3/1971 | Knight et al. | 222/342 |
| 4,982,240 | 1/1991 | Nakano | 399/358 |
| 5,264,900 | 11/1993 | Momiyama et al. | 399/256 |
| 5,444,522 | 8/1995 | Owens, Jr. | 399/358 X |
| 5,481,351 | 1/1996 | Kawai et al. | 399/359 |
| 5,734,952 | 3/1998 | Murakami et al. | 399/256 X |

FOREIGN PATENT DOCUMENTS

| | | |
|---|---|---|
| 0 341 667 | 11/1989 | European Pat. Off. . |
| 0 464 032 | 1/1992 | European Pat. Off. . |
| 29 23 394 | 12/1979 | Germany . |
| 44 27 853 | 2/1995 | Germany . |
| 1-059283 | 3/1989 | Japan . |
| 4-287082 | 10/1992 | Japan . |

OTHER PUBLICATIONS

Japanese Abstract, "Preventing Device for Clogging of Powdered Developer in Transfer Path", vol. 7, No. 206, Publication No. JP58102269, Publication date Jun. 17, 1983.

T. Kime et al., "Toner Movement Inducing Device", Xerox Disclosure Journal, vol. 20, No. 3, 1995, pp. 237–240.

Japanese Abstract, "Developer Recovering Device", vol. 10, No. 210, Publication No. JP61048875, Publication date Oct. 3, 1986.

*Primary Examiner*—Sophia S. Chen

*Attorney, Agent, or Firm*—Hill & Simpson

[57] ABSTRACT

A printer or copier has an intermediate carrier for applying toner to the recording medium. Used toner is scraped off the intermediate carrier and carried away by a conveyor helix. The conveyor helix is of a spring wire and a resistance element is provided extending between coils of the conveyor helix to intermittently catch and release the spring wire so as to cause wobbling of the conveyor helix and prevent sticking of the used toner.

6 Claims, 1 Drawing Sheet

CONVEYOR FOR USED TONER IN A CLEANING DEVICE OF AN ELECTROGRAPHIC PRINTER OR COPIER

BACKGROUND OF THE INVENTION

1. Field of the Invention

The present invention is directed to a conveyor means for used toner in a cleaning mechanism of an electrographic printer or copier device.

2. Description of the Related Art

A cleaning mechanism is allocated to the printer or copier device for the removal of toner residues and other particles from the surface of an intermediate carrier, particularly a photoconductor drum. Particles adhering to the intermediate carrier are removed using a stripper element lying against the intermediate carrier.

Such a cleaning mechanism is disclosed by European Patent Document EP-04 640 032 B1. The known cleaning mechanism contains a stripper element extending over the width of the intermediate carrier. This stripper elements scrapes off toner residues and contaminants adhering to the surface of the intermediate carrier. These residues drop into a trough from which they are conveyed out. The trough partially surrounds a conveyor worm that is coupled to a drivable shaft via a claw coupling. The conveyor worm is preferably fabricated of resilient material such as, for example, a spring wire. The used toner is conveyed out of the cleaning station by rotation of the conveyor worm.

It has now been shown that the pourability and flowability of the used toner decreases dependent on the temperature, particularly given employment of developer material that is suitable for high print image resolutions. In the extreme case, this leads to the used toner collecting in the trough of the cleaning station and no longer proceeding into the area of influence of the conveyor worm, which leads to a tunnel formation of toner. In this case, the elimination of the used toner is no longer assured.

SUMMARY OF THE INVENTION

The present invention is based on the object of providing a conveyor means for used toner in a cleaning mechanism of an electrographic printer or copier device that assures that the used toner will be reliably conveyed out of the cleaning station even given used toner having deteriorated flowability and pourability.

This and other objects and advantages of the invention are achieved by a cleaning mechanism for an electrographic printer or copier device, wherein the cleaning mechanism contains: a stripper element that strips used toner from the surface of an intermediate carrier of the printer-copier device, a trough for catching the stripped-off used toner, a conveyor helix of spring wire partially surrounded by the trough of the cleaning mechanism that rotates around a drive shaft during operation, and a resistance element for acting on the conveyor helix such that the conveyor helix is periodically compressed and released in a pulse-like manner. Developments and improvements of the invention are provided when the resistance element a spring hook that has its free end penetrating between two turns of the conveyor helix into the interior thereof and has its other end stationarily seated relative to the conveying direction of the conveyor helix. In a preferred embodiment, a spacing is provided between conveyor the helix and the trough that is of such a size that a wobbling motion of the conveyor helix as a result of the resistance element is assured.

Due to the means for producing a pulsed motion of the conveyor worm, the used toner proceeds reliably into the area of influence of the conveyor means. As a result thereof, a reliable elimination of the used toner is assured even given reduced flow and pouring behavior. Contamination of the printer or copier device due to uncontrolled emergence of the used toner from the cleaning station can be effectively prevented. Damage to or destruction of the intermediate carrier due to collected, used toner in the cleaning station cannot occur.

BRIEF DESCRIPTION OF THE DRAWINGS

An example of the invention is explained in greater detail below with reference to the drawing.

DETAILED DESCRIPTION OF THE PREFERRED EMBODIMENTS

Figure 1:
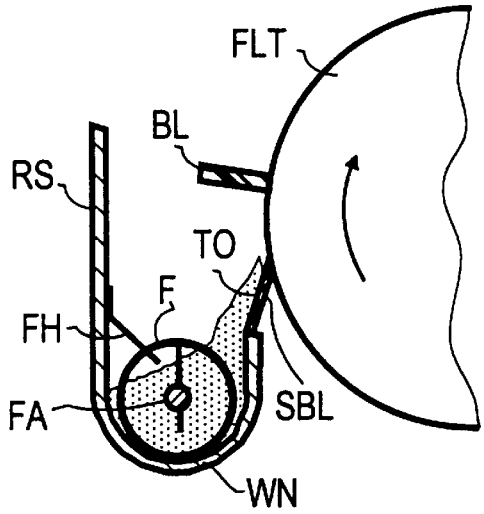
FIG. 1 is a schematic sectional view of the present invention with a view with photoconductor drum and a cleaning station.
Figure 2:
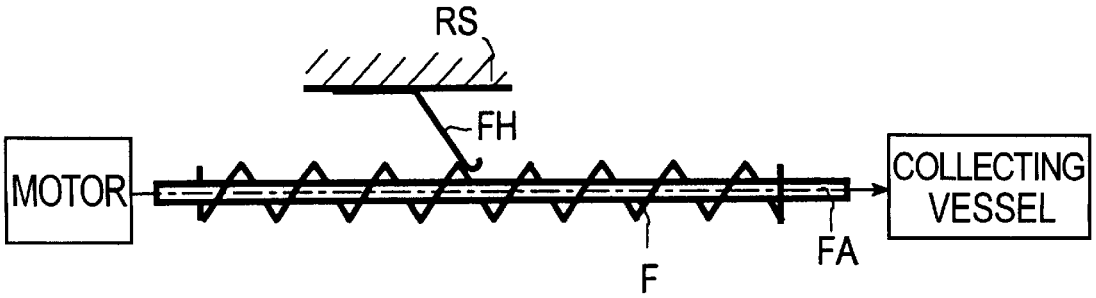
FIG. 2 is a front view of an inventive conveyor means of the cleaning station.

As shown in FIG. 1, a photoconductor drum FLT of a printer or copier rotates in a clockwise direction. A cleaning station that extends in an axial direction of the photoconductor drum FLT over the entire width thereof is arranged at the circumference of the photoconductor drum FLT.

The cleaning station RS contains a stripper element BL. A ledge with a rectangular crossection that extends over the entire width of the photoconductor FLT serves as the stripper element BL. The stripper element BL has one edge lying on the surface of the photoconductor drum FLT, so that toner particles located on the surface of the photoconductor drum FLT are scraped off by the stripper element BL upon rotation of the photoconductor drum FLT.

The particles that are scrapped off are a matter of a mixture of toner, paper fibers and other contaminants that are referred to below as used toner TO. The used toner which has been stripped off of the photoconductor drum FLT falls into a receptacle trough WN of the cleaning station RS under the force of gravity and is collected therein. In order to prevent a contamination of the environment of the cleaning station RS, a seal strip SBL that covers the gap between the cleaning station RS and the surface of the photoconductor drum FLT is arranged between the trough WN and the surface of the photoconductor drum FLT, whereby this seal strip SBL slides on the surface of the photoconductor drum FLT.

A conveyor helix F whose ends are coupled to a drive shaft FA is arranged in the trough WN of a the cleaning station RS. The conveyor helix F is composed of a spring wire. The drive shaft FA forms the rotational axis of the conveyor helix F surrounded by the trough WN. A spacing that allows a tumbling motion of the conveyor helix F transversely relative to the axial direction is provided between the conveyor helix F and the inside wall of the trough WN.

With the conveyor helix F, the used toner TO is conveyed out of the cleaning station RS into a collecting vessel shown schematically, being conveyed in a direction that is dependent on the winding direction of the conveyor helix F and on the rotational sense of the drive shaft FA.

A spring hook FH penetrates between two turns of the conveyor helix F into the interior thereof along the longitudinal extent of the conveyor helix F. With respect to the conveying direction of the conveyor helix F, that end of the spring hook FH facing away from the conveyor helix F is stationarily coupled to the housing of the cleaning station RS.

Given a rotation of the conveyor helix F, the spring hook FH is deflected in the conveying direction and is pressed out of the interior of the conveyor helix F. As viewed in the conveying direction, the conveyor helix F is thereby compressed preceding the spring hook FH and stretched following the spring hook FH. Over and above this, the conveyor helix F is deflected transversely relative to the axial direction. This pre-stress of the spring helix F is compensated in a pulse-like manner when the spring hook FH jumps over the turn of the conveyor helix F against which it is pressed. Given the pulse-like release of the conveyor helix F, the spring is excited to oscillate in an axial direction, and a wobbling motion around the drive shaft FA is superimposed thereon. Used toner TO that could collect in the gap between conveyor helix F and trough WN is thereby seized by the conveyor helix F and carried off. A collection of used toner TO is thus already prevented at the outset thereof.

Although other modifications and changes may be suggested by those skilled in the art, it is the intention of the inventors to embody within the patent warranted hereon all changes and modifications as reasonably and properly come within the scope of their contribution to the art.

We claim:

1. A cleaning mechanism for an electrographic printer or copier device having an intermediate carrier for applying toner to a recording medium, comprising:

a stripper element mounted to strip used toner from a surface of the intermediate carrier of the printer or copier device, a trough mounted to catch the stripped-off used toner, a drive shaft and a means for rotating the drive shaft;

a conveyor helix of spring wire partially surrounded by the trough that rotates around the drive shaft during operation, and a resistance element mounted to act on the conveyor helix such that the conveyor helix is periodically compressed and released pulse-like during rotation.

2. A cleaning mechanism for an electrographic printer or copier device having an intermediate carrier for applying toner to a recording medium, comprising:

a stripper element mounted to strip used toner from a surface of the intermediate carrier of the printer or copier device, a trough mounted to catch the stripped-off used toner, a drive shaft and a means for rotating the drive shaft;

a convevor helix of spring wire partially surrounded by the trough that rotates around the drive shaft during operation, and a resistance element mounted to act on the conveyor helix such that the conveyor helix is periodically compressed and released pulse-like during rotation, said resistance element being a spring hook that has its free end penetrating between two turns of the conveyor helix into an interior thereof and has its other end stationarily seated relative to a conveying direction of the conveyor helix.

3. A cleaning mechanism according to claim 1, wherein said trough is spaced from said conveyor helix by a spacing of such a size that a wobbling motion of the conveyor helix is assured during rotation of said conveyor helix.

4. A conveyor for used toner in a cleaning mechanism of an electrographic printer or copier device, the printer or copier device having an intermediate carrier for applying toner onto a recording medium, comprising:

a stripper element mounted to strip used toner from a surface of said intermediate carrier, a trough mounted to catch the used toner that is stripped by said stripper element, a drive shaft and a means for driving the drive shaft, a conveyor helix partially surrounded by said trough that rotates around said drive shaft, and a resistance element mounted to act on the conveyor helix such that the conveyor helix is periodically compressed and released pulse-like as said conveyor helix rotates.

5. A conveyor for used toner in a cleaning mechanism of an electropgraphic printer or copier device, the printer or copier device having an intermediate carrier for applying toner onto a recording medium, comprising:

a stripper element mounted to strip used toner from a surface of said intermediate carrier, a trough mounted to catch the used toner that is stripped by said stripper element, a drive shaft and a means for driving the drive shaft, a conveyor helix partially surrounded by said trough that rotates around said drive shaft, and a resistance element mounted to act on the conveyor helix such that the conveyor helix is periodically compressed and released pulse-like as said conveyor helix rotates, said resistance element being a spring hook that has its free end penetrating between two turns of said conveyor helix into an interior thereof and has its other end stationarily seated relative to a conveying direction of the conveyor helix.

6. A conveyor as claimed in claim 4, wherein said conveyor helix and said trough are spaced apart by a spacing that is of such a size that said conveyor helix undergoes a wobbling motion within said trough.

* * * * *